US005850862A

United States Patent [19]

Miller

[11] Patent Number: 5,850,862

[45] Date of Patent: Dec. 22, 1998

[54] ROLLING PROTECTIVE SHUTTERS

[76] Inventor: James V. Miller, 893 N. Maryknoll Cir., Glen Ellyn, Ill. 60137

[21] Appl. No.: 804,100

[22] Filed: Feb. 20, 1997

[51] Int. Cl.[6] ..... E06B 09/08

[52] U.S. Cl. ..... 160/133; 160/183; 160/235

[58] Field of Search ..... 160/133, 183, 160/23.1, 26, 270, 271, 272, 273.1, 32, 35, 36, 41, 84.06, 172 R, 236, 232, 235

[56] References Cited

U.S. PATENT DOCUMENTS

| | | | |
|---|---|---|---|
| 638,314 | 12/1899 | Blades . | |
| 845,526 | 2/1907 | Collins . | |
| 876,593 | 1/1908 | Rush . | |
| 1,579,839 | 4/1926 | Raper . | |
| 3,431,964 | 3/1969 | Rogers | 160/23 |
| 4,037,639 | 7/1977 | Jones | 160/133 |
| 4,294,302 | 10/1981 | Ricke, Sr. | 160/133 |
| 4,345,635 | 8/1982 | Solomon | 160/133 |
| 4,519,434 | 5/1985 | Forquer | 160/133 |
| 4,807,687 | 2/1989 | Finch et al. | 160/133 |
| 4,930,563 | 6/1990 | Finch et al. | 160/271 |
| 5,070,925 | 12/1991 | Paule | 160/133 |
| 5,209,281 | 5/1993 | Kraeutler | 160/84.1 |
| 5,365,990 | 11/1994 | Ueda | 160/23.1 |
| 5,426,893 | 6/1995 | Hoffman | 49/464 |
| 5,469,905 | 11/1995 | McKinney et al. | 160/35 |
| 5,575,322 | 11/1996 | Miller | 160/133 |
| 5,586,592 | 12/1996 | McGregor | 160/133 |
| 5,601,130 | 2/1997 | Werner et al. | 160/183 |
| 5,611,383 | 3/1997 | Hoffman | 160/133 |
| 5,613,539 | 3/1997 | Kraler | 160/32 |

OTHER PUBLICATIONS

Bubendorff AG Rolax® Brochure, 4 pages—prior art.

Bubendorff AG Atix® Brochure, 2 pages—prior art.

Reflexa Individuelle Sonnenschutztechnik Brochure, Mar. 1994, 16 pages.

Schanz GmbH Spezial Rolläden Für Alle Fenster–Formen Brochure, 20 pages—prior art.

Schanz GmbH Studio Star® Brochure, 18 pages—prior art.

Schanz GmbH WigaStar® Brochure, 2 pages—prior art.

Schanz GmbH WigaStar® Brochure, 12 pages—prior art.

SOMFY, Shutters In Motion Product Catalog Nov. 1993, pp. 6–17.

Sweet's General Building & Renovation 1993 Catalog File, Enviroblind Exterior Rolling Shutters, Environmental Seal and Security Co., Inc. #B489, 4 pages.

Sweet's General Building & Renovation 1993 Catalog File, Hurst Shutters Accordion Shutters/Removable Shutters, Hurst Awning Company, Inc. #B492, 8 pages.

Sweet's General Building & Renovation 1993 Catalog File, Rolladen Rollshutters, Rolladen Inc., #B499, 8 pages.

(List continued on next page.)

*Primary Examiner*—David M. Purol

*Attorney, Agent, or Firm*—Marshall, O'Toole, Gerstein, Murray & Borun

[57] ABSTRACT

A rolling shutter assembly having a shutter support member and a shutter coupled to the shutter support member. The shutter has a plurality of individual slats and a plurality of hinges interconnecting the slats. Each of the slats has a pair of end portions, and the slats include a first set of slats and a second set of slats, each of the slats in the first and second sets being alternated so that each of the hinges is connected to one of the slats in the first set and one of the slats in the second set. The shutter further includes a plurality of extension members extending from the slats and/or the hinges. The shutter assembly has a pair of shutter tracks and an arrangement for rolling the shutter from an extended position in which the end portions of the slats are disposed in the shutter tracks to a retracted position in which the shutter is rolled up on the shutter support member. The shutter tracks further include guide channels and a guide arrangements which cause the extension members to be disposed within the guide channels to cause the slats in the first set of slats to occupy a first relative position and the slats in the second set of slats to occupy a second relative position while the shutter is being unrolled.

30 Claims, 5 Drawing Sheets

OTHER PUBLICATIONS

Sweet's General Building & Renovation 1993 Catalog File, Rollaway Insulating Security Shutters, Roll–A–Way, #B500, 8 pages.

Sweet's General Building & Renovation 1993 Catalog File, Solaroll, Solaroll Shade & Shutter Corporation, Catalog 561, #B505, 44 pages.

Sweet's General Building & Renovation 1993 Catalog File, "Custom Designed" Roll–A–Flex Rolling Shutter protection system, Folding Shutter Corporation, #B507, 4 pages.

Sweet's General Building & Renovation 1993 Catalog File, Willard Island Shutter Brochure, Willard Shutter Company, Inc., #B515, 12 pages.

Sweet's General Building & Renovation 1993 Catalog File, QMI Roll Shutter Supply, "BuyLine 6925" 4 pages.

Sweet's General Building & Renovation 1996 Catalog File, All Broward Hurricane Panel Company, Inc., #B483, 4 pages.

Sweet's General Building & Renovation 1996 Catalog File, Exterior Rolling Shutters Brochure, Enviroblind, #B489, 4 pages.

Sweet's General Building & Renovation 1996 Catalog File, Shutters, Roll–Up Shutters/Accordian Shutters/Removable Shutters/Tropic Bahama Shutters Brochure, Hurst Awning Company Inc., #B492, 8 pages.

Sweet's General Building & Renovation 1996 Catalog File, HomeSafe®/CounterSafe®/StoreSafe® Brochure, QMI Roll Shutter Supply, 08667/QMI, "BuyLine 6925" 4 pages.

Sweet's General Building & Renovation 1996 Catalog File, rolladen® rollshutters Brochure, Rolladen, Inc., #B499, 8 pages.

Sweet's General Building & Renovation 1996 Catalog File, Roll○a○way® Storm and Security Shutters, #B500, 8 pages.

SIRO Safety Roller Blind brochure 4 pages—prior art.

SIRO Aluminum Roller Grate LM72 brochure, 4 pages—prior art.

LAKAL Rolladensysteme, LAKEL Profil AHS 75 brochure, 4 pages—prior art.

ROLLING PROTECTIVE SHUTTERS

BACKGROUND OF THE INVENTION

The present invention is directed to a rolling protective shutter assembly which has a protective shutter, for covering a window or door opening, that may be rolled up into a shutter housing when not in use.

Rolling protective shutters are conventional and are used to provide protection against extreme weather conditions and to deter theft, for example. One such rolling protective shutter is disclosed in U.S. Pat. No. 5,575,322, issued to Miller on Nov. 19, 1996, entitled "Rolling Protective Shutters," which is hereby expressly incorporated by reference herein. As shown in FIGS. 1 and 2 of that patent, the Miller shutter is composed of a plurality of individual slats and a plurality of hinges interconnecting the slats. Each of the slats has a pair of end portions, and the slats include a first set of slats and a second set of slats, each of the slats in the first and second sets being alternated so that each of the hinges is connected to one of the slats in the first set and one of the slats in the second set. The shutter assembly has a pair of shutter tracks and means for rolling the shutter from an extended position in which the end portions of the slats are disposed in the shutter tracks to a retracted position in which the shutter is rolled up on a shutter support member. The hinges and the shutter tracks are adapted to facilitate, when the shutter is in the extended position, the slats in the first set of slats to occupy a first relative position and the slats in the second set of slats to occupy a second relative position.

SUMMARY OF THE INVENTION

In one aspect, the invention is directed to a rolling shutter assembly having a guide means and a pair of guide channels which facilitate the shaping of the shutter as the shutter is unrolled to an extended position. During the unrolling of the shutter, slat extension members on the shutter members in a first set of shutter members are directed by the guide means into the guide channels.

The rolling shutter assembly has a shutter support member, a shutter coupled to the shutter support member, and a pair of shutter tracks. The shutter is formed of a plurality of shutter members comprising a slat and a hinge connected to the slat. The shutter assembly has means for rolling the shutter from an extended position in which portions of the slats are disposed in the shutter tracks to a retracted position in which the shutter is rolled up on the shutter support member. The hinges and the shutter tracks are adapted to facilitate the slats to occupy different relative orientations when the shutter is in the extended position.

The shutter members may be composed of a first set of shutter members and a second set of shutter members, each of the shutter members in the first set having an end portion with a first extension member which extends outwardly from the end portion. In alternative embodiments, the first extension member can extend from either the slat or the hinge of the shutter member of the first set. The hinges and the shutter tracks may include means for facilitating the first and second sets of slats to occupy different relative orientations when the shutter is in its extended position.

Each of the shutter tracks has an associated guide channel, and each guide channel has an associated guide means. Each guide means causes the first extension members of each of the shutter members in the first set of shutter members to be disposed within the associated guide channel when the shutter is in the extended position.

Some or all of the shutter members in the second set of shutter members may be provided with a second extension member. The second extension members are adapted to pass the guide means without being directed into the guide channel and to remain external to the guide channel while the shutter is unrolled. In alternative embodiments, the second extension member can extend from either the slat or the hinge of the shutter member of the second set.

In another aspect, the invention is directed to a rolling shutter assembly having a shutter support member, a shutter coupled to the shutter support member and comprising a plurality of slats and a plurality of hinges interconnecting the slats, and a rigid member adapted to engage a plurality of the hinges when the shutter is in an extended position. The shutter assembly has a pair of shutter tracks and means for rolling the shutter from the extended position in which the slat portions are disposed in the shutter tracks to a retracted position in which the shutter is rolled up on the shutter support member. The rigid member prevents motion of a given engaged hinge relative to the other engaged hinges, and also prevents the rotation of the slats attached to the engaged hinges about the engaged hinge.

The rigid member may be composed of an inner member having a plurality of first jaws and an outer member having a plurality of second jaws that correspond to the first jaws. The inner member and outer member are adapted to slide over each other in a manner that allows the first and second jaws to be biased together or apart. The first and second jaws are adapted to engage the hinges on the shutter as described above when the first and second jaws are biased together.

In another aspect, the invention is directed to a rolling shutter assembly having a shutter support member, a shutter coupled to the shutter support member and comprising a plurality of slats and a plurality of hinges interconnecting the slats, with some of the hinges comprising first and second spiral sections and a link. The shutter assembly has a pair of shutter tracks and means for rolling the shutter from the extended position in which the slat portions are disposed in the shutter tracks to a retracted position in which the shutter is rolled up on the shutter support member.

The first and second spiral sections are attached to first and second slats interconnected by the hinge, respectively. The link is comprised of third and fourth spiral sections. The third spiral section interlocks the first spiral section in a manner that allows rotation of the first slat relative to the link, and the fourth spiral section interlocks the second spiral section in a manner that allows rotation of the second slat relative to the link. In one embodiment, the hinges with the links are adapted to allow the first slat to rotate about the hinge through an arc of up to 330° relative to the second slat.

In yet another aspect, the invention is directed to a rolling shutter assembly having a shutter support member, a shutter coupled to the shutter support member and comprising a plurality of slats and a plurality of hinges interconnecting the slats, with some of the hinges comprising a first hinge section and a second hinge section with a rigid member adapted to stop the rotation of the first hinge section relative to the second hinge section at a fixed point in the rotation. The shutter assembly has a pair of shutter tracks and means for rolling the shutter from the extended position in which the slat portions are disposed in the shutter tracks to a retracted position in which the shutter is rolled up on the shutter support member.

The first and second hinges sections may be composed of interlocking spiral sections. Additionally, the rigid member may be composed of a cantilever beam that extends from the first hinge section, with the second hinge section bearing upon the beam when the second hinge section reaches a fixed point in the rotation.

The features and advantages of the invention will be apparent to those of ordinary skill in the art in view of the detailed description of the preferred embodiments, which is made with reference to the drawings, a brief description of which is provided below.

DETAILED DESCRIPTION OF THE PREFERRED EMBODIMENTS

Figure 1:
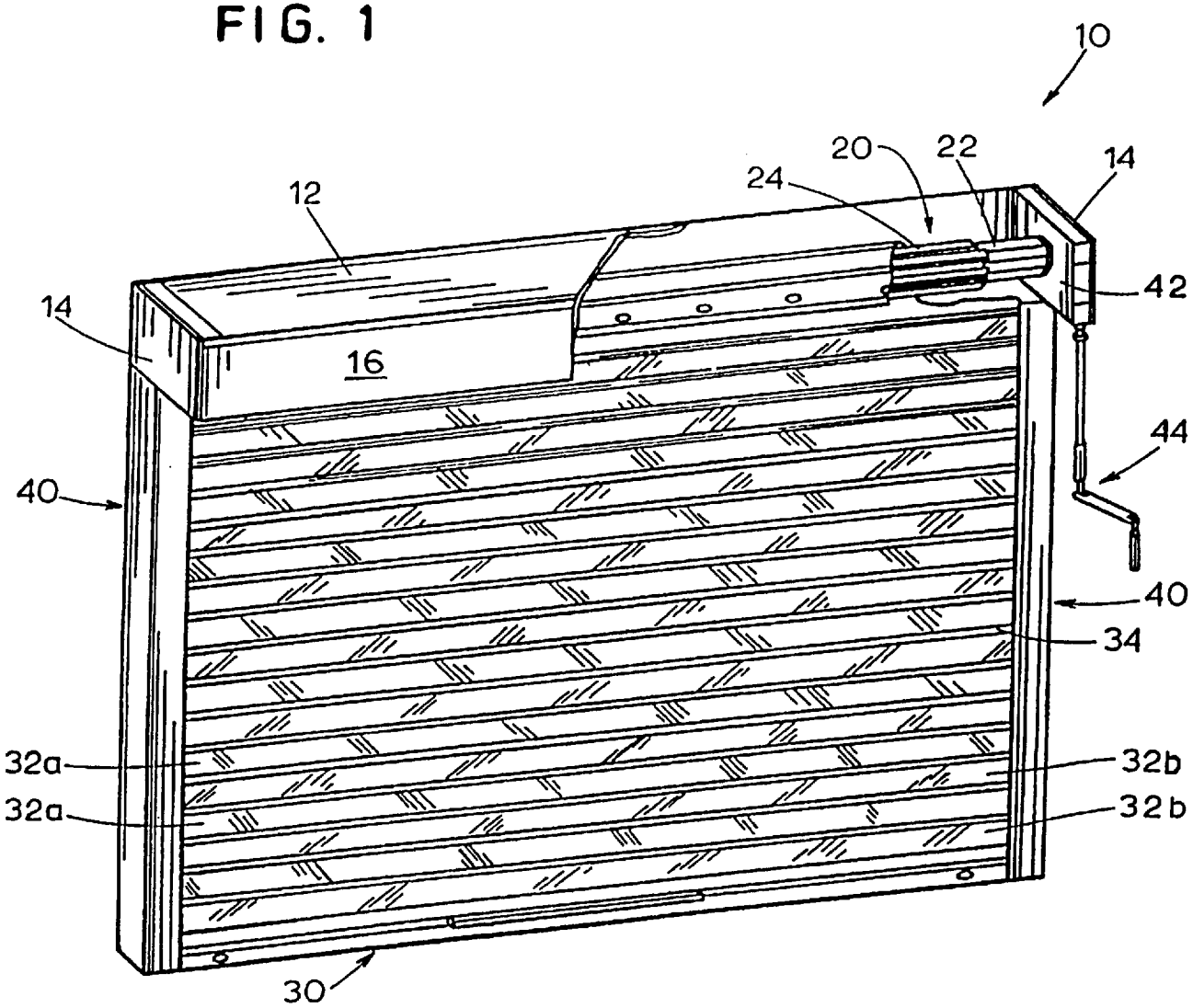
FIG. 1 is a perspective view of a first embodiment of a rolling shutter assembly in accordance with the invention.
Figure 2:
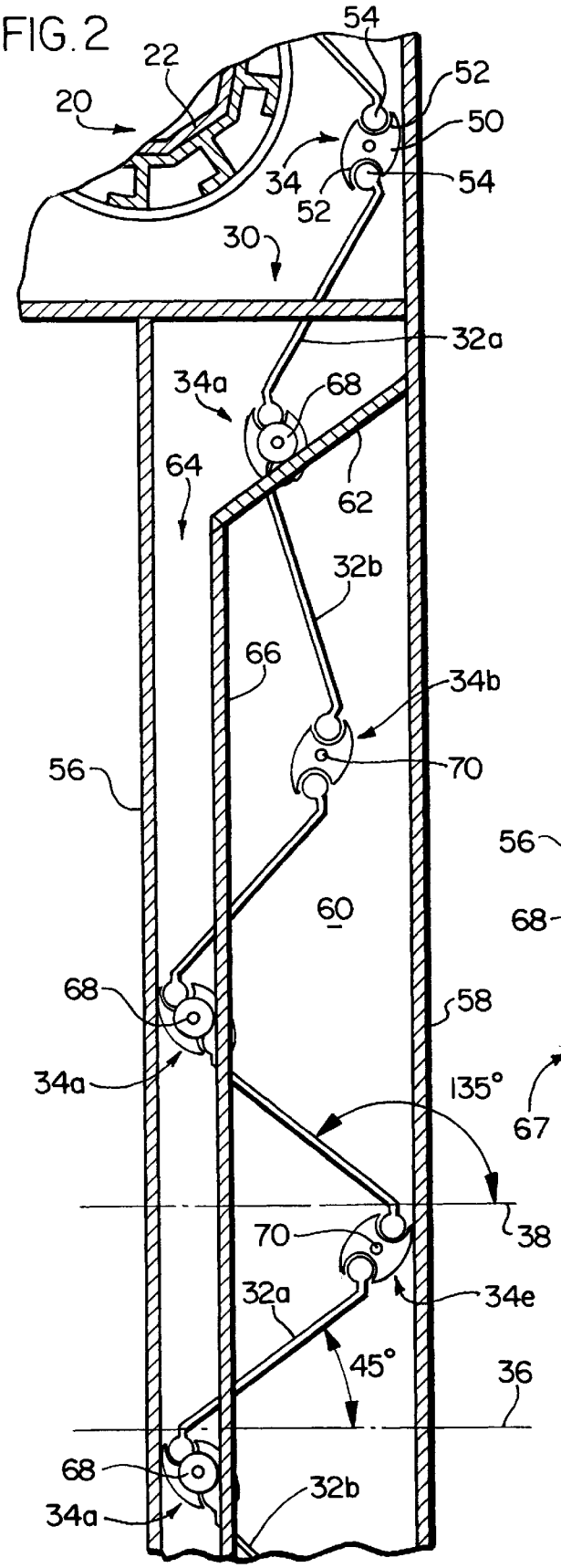
FIG. 2 is a cross-sectional side view of a portion of the shutter assembly of FIG. 1.

A first embodiment of a rolling shutter assembly 10 in accordance with the invention is shown in FIGS. 1–2. Referring to FIG. 1, the shutter assembly 10 has a shutter housing which includes a top wall 12, a pair of side walls 14, and a front wall 16. A shutter support member 20 is mounted for rotation within the shutter housing. The support member 20 includes a generally cylindrical central shaft 22 and a plurality of mounting members 24 fixed to the shaft 22.

The upper end of a rolling shutter 30 is coupled to the mounting members 24. The shutter 30 is composed of a plurality of individual, elongate slats 32. The slats 32, each of which is substantially flat, having two substantially planar side portions, and which may be composed of steel, are interconnected by a plurality of hinges 34, each of which joins together a pair of adjacent slats 32. The slats 32 include a first set of slats 32*a* and a second set of slats 32*b*, the first and second sets of slats being alternated, so that each hinge 34 is connected to one of the slats 32*a* in the first set and one of the slats 32*b* in the second set.

When the shutter 30 is in its unrolled position as shown in FIG. 2, the slats 32*a* in the first set occupy a first relative position in which they are aligned with a first angled direction, shown to be about 45° with respect to a horizontal axis 36, and the slats 32*b* in the second set occupy a second relative position in which they are aligned with a second angled direction, shown to be about 135° with respect to a horizontal axis 38. The angular position of the slats 32 could be varied so that the slats 32*a* in the first set occupy an angled direction between about 10° and about 80° with respect to the horizontal and so that the slats 32*b* in the second set occupy an angled direction between about 100° and about 170° with respect to the horizontal.

Referring back to FIG. 1, the ends of the slats 32 are disposed within a pair of shutter tracks 40. The shutter assembly 10 has a gearbox 42 which interconnects the rotatable shaft 22 with a handle 44 via a conventional gear assembly (not shown). When mounted to protect a window, the shutter tracks 40 of the shutter assembly 10 are positioned on either side of the window and the shutter housing is positioned over the top of the window. When the shutter 30 is not in use, it is rolled up on the shutter support member 20 via the handle 44 so that it is at least partially enclosed by the shutter housing. The handle 44 may be disposed on a rear portion of the shutter assembly 10 so that the shutter 30, when attached over a window for example, can be unrolled from inside the window.

Referring to FIG. 2, each of the hinges 34 is composed of an elongate member 50 having a pair of semi-circular sockets 52 formed therein and a pair of circular rods 54 pivotally disposed therein, each of the rods 54 being fixed to one of the slats 32 adjacent the hinge 34. Since the sockets 52 cover slightly over half the diameter of the rods 54, the rods 54 are permanently retained within the sockets 52. When the shutter 30 is in its unrolled position as shown in FIG. 2, each of the hinges 34 makes contact with one side of the shutter tracks 40.

The hinges 34 are grouped into a first set of hinges 34*a* and a second set of hinges 34*b* alternated with the first set of hinges 34*a*. The first set of hinges 34*a* include first extension members, such as rollers 68, which extend outwardly from the end of the hinge 34*a*. The second set of hinges 34*b* may include second extension members, such as pins 70, which extend outwardly from the end of the hinge 34*b*.

Figure 3:
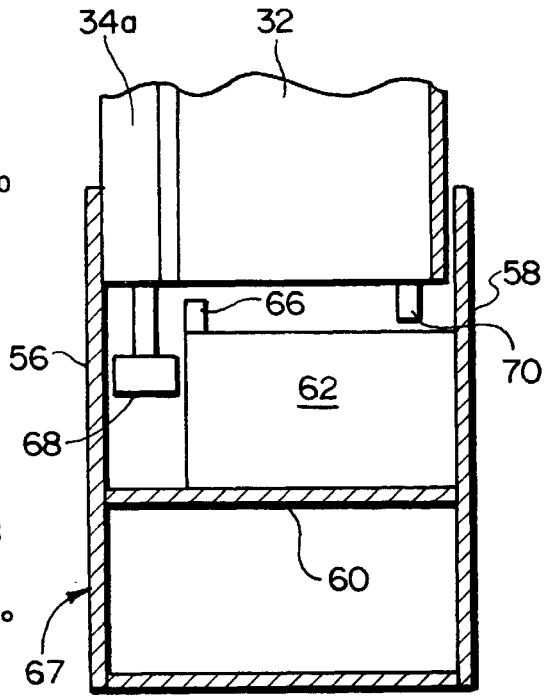
FIG. 3 is a cross-sectional top view of a portion of the shutter assembly of FIG. 1.

The structure of the shutter tracks 40 is illustrated in FIGS. 2 and 3. Each shutter track 40 is composed of a pair of side walls 56, 58 joined by an end wall 60. A plate 62 is attached proximate the end wall 60 and directs the roller 68 on hinge 34*a* into a guide channel 64 as the shutter 30 is unrolled from the shutter support member 20. The guide channel 64 is formed by the side wall 56 and a guide wall 66. As shown in FIG. 3, a structural support member 67 may be disposed on the outside of the end wall 60 to provide additional structural support to the shutter track 40.

Referring to FIG. 2, the plate 62 and guide channel 66 act to shape the shutter 30 as it is unrolled from the shutter support member 20 to an extended position. As the shutter 30 is unrolled, the rollers 68 on the hinges of the first set 34*a* come into contact with the plate 62 which directs the hinge 34*a* toward the guide channel 64. Once in the guide channel 64, the guide wall 66 retains the roller 68 within the guide channel 64. As illustrated in FIG. 3, the pins 70 extend far enough from the hinges 34*b* to contact the guide wall 66 while avoiding the plate 62, thus preventing the hinges 34*b* from entering the guide channel 64. Consequently, as the shutter 30 is unrolled, the hinges 34*a* are disposed on one side of the guide wall 66 and the hinges 34*b* are disposed on the other side of the guide wall 66, thus forming the desired V-shape, as shown in FIG. 2.

Extension members, such as rollers 68 and pins 70 disclosed herein and in subsequent examples, are attached to the hinges 34 for illustrative purposes. It is within the province of one skilled in the art to attach rollers, pins, bushings or other extension members to the slats 32 to achieve the same results.

Figure 4:
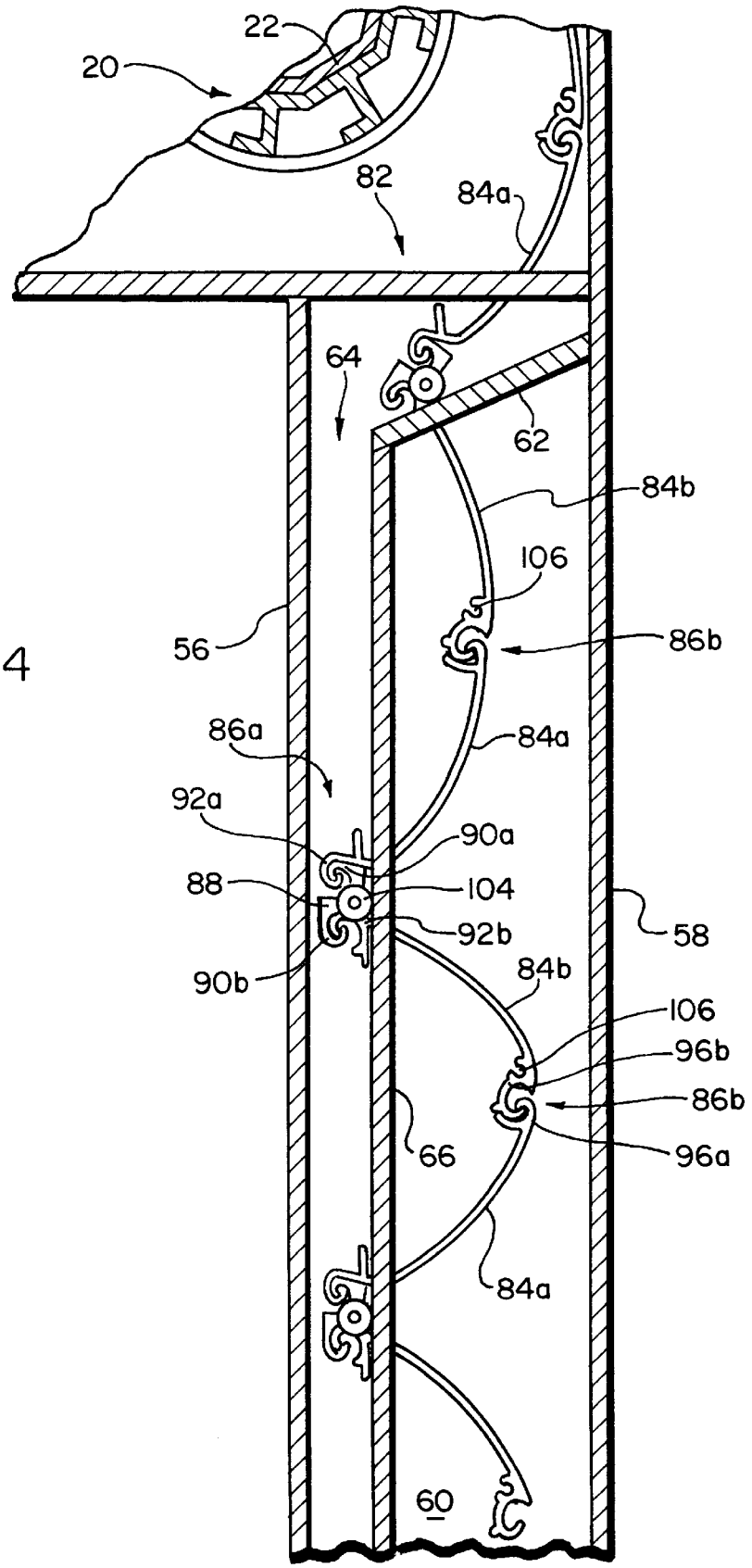
FIG. 4 is a cross-sectional side view of a portion of a second embodiment of a shutter assembly in accordance with the invention.
Figure 6:
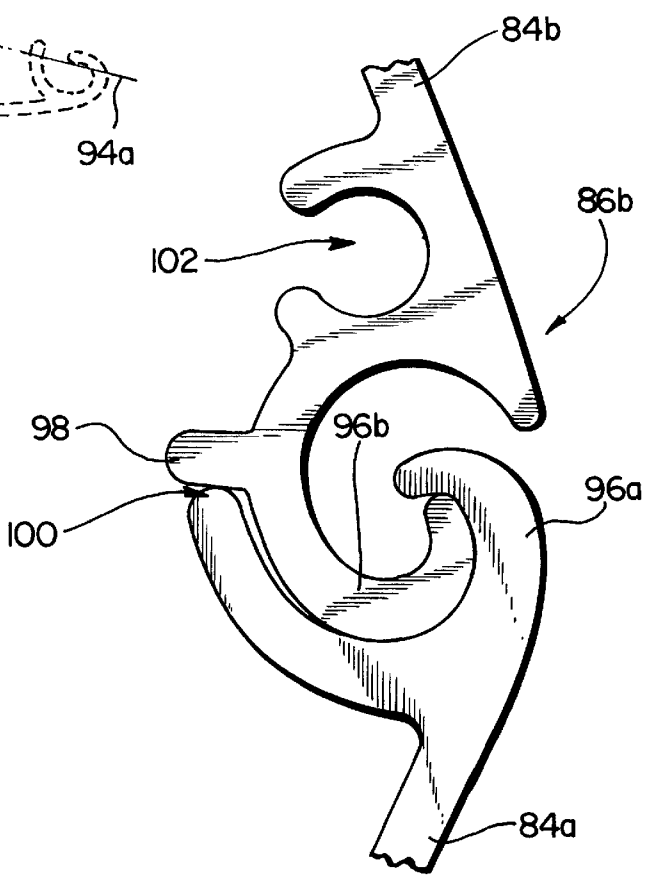
FIG. 6 is a side view or a pair of individual shutter slats pivotally interconnected via another alternative hinge.
Figure 5:
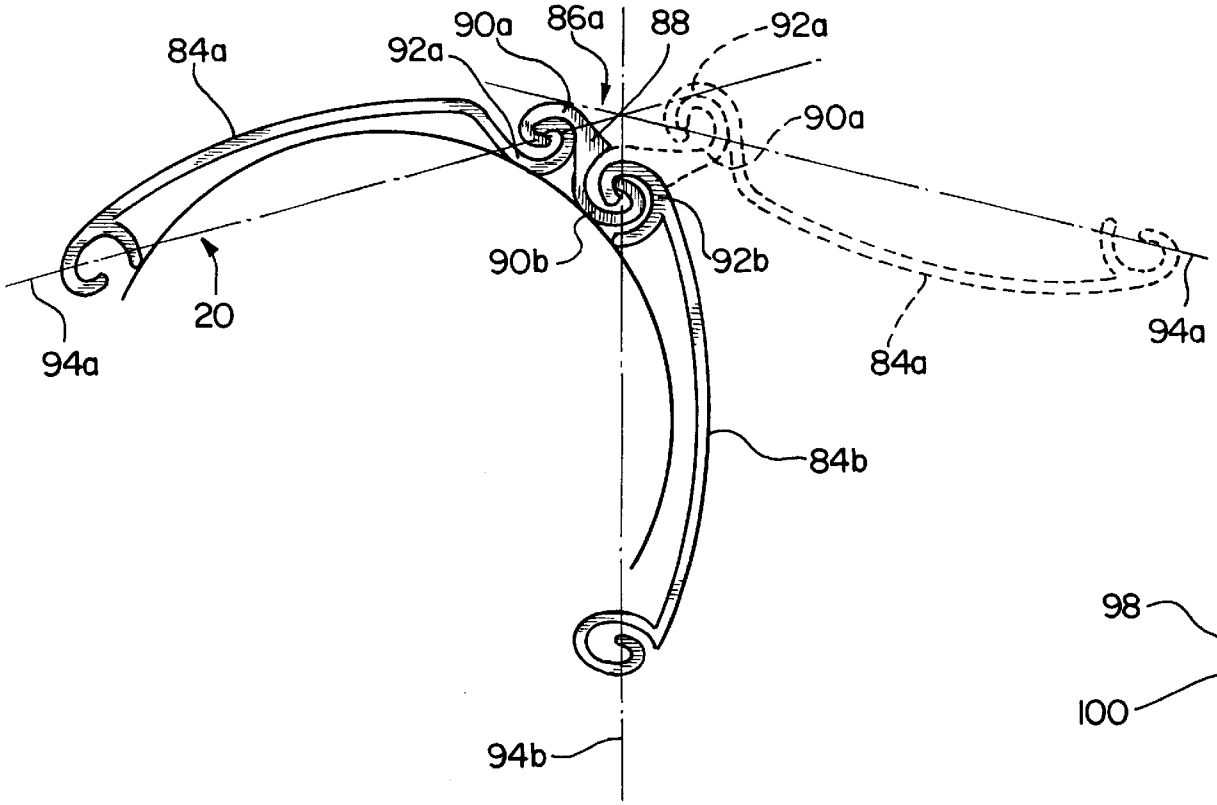
FIG. 5 is a side view of a pair of individual shutter slats pivotally interconnected via an alternative hinge.

A portion of a second embodiment of a shutter assembly 80 is shown in FIGS. 4–6. The shutter assembly 80 has the same components of the shutter assembly 10 of FIG. 1, except that the structure of the shutter 82 is different. The shutter assembly 80 has a shutter 82 which has a first set of slats 84*a* and a second set of slats 84*b* alternated with the first set of slats 84*a*. The shutter assembly 80 also has a shutter 82 which has a first set of spiral hinges 86*a* and a second set of spiral hinges 86*b* alternated with the first set of spiral hinges 86*a*.

An example of a spiral hinge of the first set 86*a* is illustrated in FIG. 5. Each hinge 86*a* is composed of a link 88 having a first pair of spiral sections 90*a*, 90*b* formed therein, and a second pair of spiral sections 92*a*, 92*b* fixed to slats 84*a*, 84*b*, respectively. Spiral section 90*a* interlocks spiral section 92*a* and spiral section 90*b* interlocks spiral section 92*b* in a manner that allows the rotation of slats 84*a*, 84*b* relative to link 88. Hinge 86*a* permits a broad range of motion for slat 84*a* relative to slat 84*b*. This range includes acute angles when shutter 80 is rolled up on shutter support member 20, shown to be about 75° between a center line 94*a* on slat 84*a* and a center line 94*b* on slat 84*b*, and extreme angles when shutter 80 is in the extended position, shown to be about 283° between center lines 94*a*, 94*b*. Persons of skill in the art will be able to adapted hinge 86*a* to allow for a range of motion in excess of 330°.

Referring to FIG. 6, an example of a hinge of the second set 84*b* is illustrated. Hinge 84*b* is composed of a pair of spiral sections 96*a*, 96*b* fixed to slats 84*a*, 84*b*, respectively. Spiral section 96*a* interlocks spiral section 96*b* in a manner that allows the rotation of slat 84*a* relative to slat 84*b*. Spiral section 96*b* may be provided with a rigid member, such as extrusion 98, which extends from spiral section 96*b* and engages a tip 100 of spiral section 96*a* at a point in the rotation, thus preventing further rotation in hinge 86*b*. Extrusion 98 is essentially a cantilever beam extending from spiral section 96*b*, but those skilled in the art will identify other methods for stopping the rotation of hinge 86*b* at a fixed point. Spiral section 96*b* may also be provided with an opening, such as boss 102, for attachment of an extension member, such as a roller or pin as described above.

Referring back to FIG. 4, the plate 62 and guide channel 66 act to shape the shutter 82 as it is unrolled from the shutter support member 20 to its extended position. As the shutter 82 is unrolled, rollers 104 on the hinges of the first set 86*a* come into contact with the plate 62 which directs the hinge 86*a* toward the guide channel 64. Once in the guide channel 64, the guide wall 66 retains the roller 104 within the guide channel 64. Pins 106 extend far enough from the hinges 86*b* to contact the guide wall 66 while avoiding the plate 62, thus preventing the hinges 86*b* from entering the guide channel 64. Consequently, as the shutter 82 is unrolled, the hinges 86*a* are disposed on one side of the guide wall 66 and the hinges 86*b* are disposed on the other side of the guide wall 66, thus forming the desired V-shape.

Figure 7:
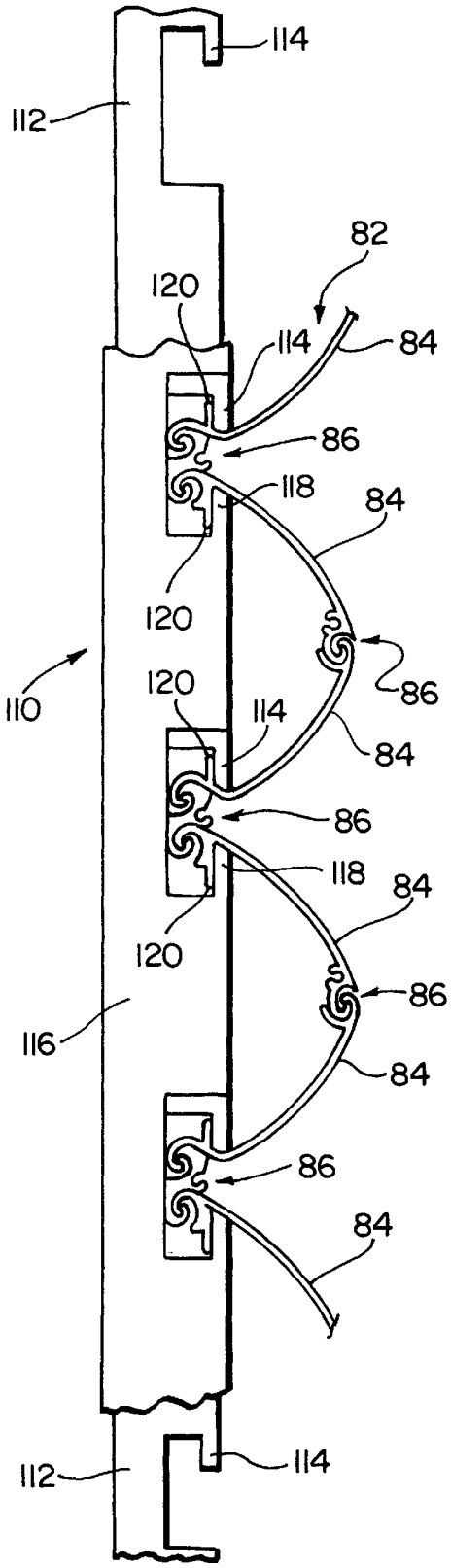
FIG. 7 is a side view of a shutter assembly engaged by a unitizing bar.

FIG. 7 illustrates the use of a rigid member, such as the unitizing bar 110, to increase the strength of shutter 82 against impact. The unitizing bar 110 is adapted to attach to the shutter 82 by engaging a plurality of hinges 86 in a manner that prevents the relative motion of an engaged hinge 86 with respect to the other engaged hinges 86, and prevents the rotation of the slats 84 about the engaged hinges 86.

One example of the unitizing bar 110, as illustrated in FIG. 7, is composed of an inner member 112 having a plurality of upper jaws 114 and an outer member 116 having a plurality of lower jaws 118 corresponding to the upper jaws 114. The outer member 116 is adapted to slide over the inner member 112 so that the jaws 114, 118 can be opened and closed. The engaged hinges 86 may be provided with extrusions 120 which are grasped by the jaws 114, 118 when the unitizing bar 110 is closed around the engaged hinges 86. The unitizing bar 110 further includes a locking mechanism (not shown) for securing the unitizing bar 110 in the closed position. Other rigid members for securing the hinges 86 and mechanisms for engaging the hinges 86 will be apparent to those skilled in the art.

Figure 8:
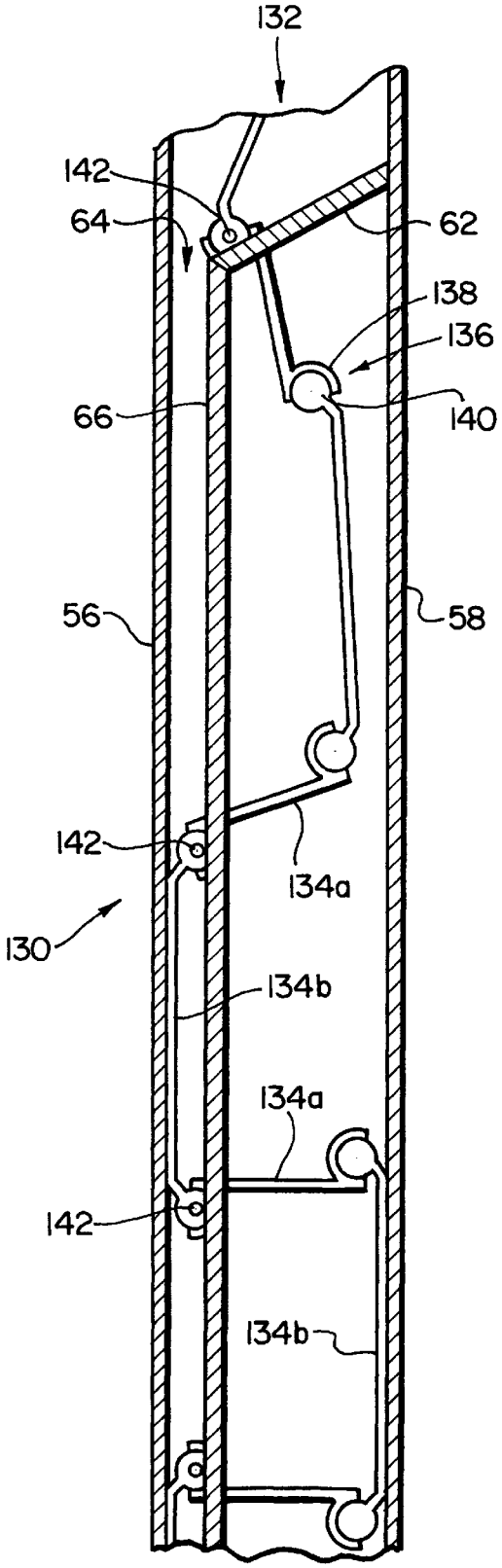
FIG. 8 is a cross-sectional side view of a portion of a third embodiment of a shutter assembly in accordance with the invention.

A portion of a third embodiment of a shutter assembly 130 is shown in FIG. 8. The shutter assembly 130 has the same components of the shutter assembly 10 of FIG. 1, except that the structure of the shutter is different. The shutter assembly 130 has a shutter 132 which has a first set of slats 134*a* and a second set of slats 134*b* alternated with the first set of slats 134*a*. Each of the slats 134*a* in the first set occupies a substantially horizontal position and each of the slats 134*b* in the second set occupies a substantially vertical position.

The shutter 132 has a plurality of elongate hinges 136, each of which is composed of a semi-circular member 138 with a socket formed therein and a circular rod 140 pivotally disposed in the socket member 138, the rods 140 being integrally formed with the slats 134*a*, 134*b*. Since the socket members 138 cover slightly over half the diameter of the rods 140, the rods 140 are permanently retained within the socket members 138. When the shutter 132 is in its unrolled position, the vertically disposed slats 134*b* make contact with the sides of the shutter tracks 40.

The plate 62 and guide channel 66 act to shape the shutter 130 as it is unrolled from the shutter support member 20 to its extended position. Pins 142 extend from the rods 140 of the slats 134*b* that will contact side wall 56 when the shutter 130 is in the extended position. As the shutter 130 is unrolled, pins 142 come into contact with the plate 62 which directs the slat 134*b* toward the guide channel 64. Once in the guide channel 64, the guide wall 66 retains the pins 142 within the guide channel 64.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A rolling shutter assembly, comprising:

a shutter support member;

a shutter coupled to said shutter support member, said shutter comprising a plurality of shutter members, said shutter members each comprising a slat and a hinge connected to said slat, said shutter members being grouped in a first set and a second set, each of said shutter members in said first and second sets being alternated, each of said shutter members in said first set having a first end portion with a first extension member which extends outwardly from said first end portion;

a pair of shutter tracks each having first and second side walls and an end wall;

means for rolling said shutter from an extended position in which said first end portions of said shutter members are disposed in said shutter tracks to a retracted position in which said shutter is rolled up on said shutter support member;

a pair of guide channels, each of said guide channels being associated with one of said shutter tracks; and guide means associated with each of said guide channels, said guide means causing said first extension members of said shutter members to be disposed within said guide channels when said shutter is in said extended position.

2. An assembly as defined in claim 1 wherein said first end portions with said first extension members are connected to said hinges of said shutter members of said first set.

3. An assembly as defined in claim 1 wherein said hinges of said shutter members of said first set each comprise:

a first spiral section attached to a slat of a shutter member of said first set;

a second spiral section attached to a slat of a shutter member of said second set; and a link comprising third and fourth spiral sections, said third spiral section adapted to interlock said first spiral section in a manner that allows rotation of said shutter member of said first set relative to said link, and said fourth spiral section adapted to interlock said second spiral section in a manner that allows rotation of said shutter member of said second set relative to said link.

4. An assembly as defined in claim 1 wherein said first extension members are connected to said links.

5. An assembly as defined in claim 1 wherein said first and second side walls of said shutter tracks are spaced apart by a distance and wherein each of said guide channels has a width substantially less than said distance.

6. An assembly as defined in claim 1 wherein said guide channels comprise a rigid member oriented parallel to said second side wall, said rigid member and said second side wall being spaced apart by a distance greater than a width of said first extension members.

7. An assembly as defined in claim 1 wherein said shutter members of said second set further comprise a second end portion with a second extension member which extends outwardly from said second end portion, said second extension members adapted to avoid said guide means and to be disposed outside of said guide channels when said shutter is in said extended position.

8. An assembly as defined in claim 1 wherein said guide means comprises an angled plate.

9. An assembly as defined in claim 1 wherein said guide means comprises an angled plate attached to said end wall proximate said first side wall and said shutter support member and angled toward said second side wall and away from said shutter support member.

10. An assembly as defined in claim 1 wherein each of said extension members comprises a pin.

11. An assembly as defined in claim 1 wherein each of said extension members comprises a roller.

12. A rolling shutter assembly, comprising:

a shutter support member;

a shutter coupled to said shutter support member, said shutter comprising a plurality of shutter members, said shutter members each comprising a slat and a hinge connected to said slat, said shutter members being grouped in a first set and a second set, each of said shutter members of said first set having a first end portion with a first extension member which extends outwardly from said first end portion;

a pair of shutter tracks each having first and second side walls and an end wall;

means for rolling said shutter from an extended position in which said end portions of said shutter members are disposed in said shutter tracks to a retracted position in which said shutter is rolled up on said shutter support member;

a pair of guide channels, each of said guide channels being associated with one of said shutter tracks; and guide means associated with each of said guide channels, said guide means causing said first extension members of said shutter members in said first set to be disposed within said guide channels when said shutter is in said extended position.

13. An assembly as defined in claim 12 wherein said first extension members are connected to said hinges of said shutter members of said first set.

14. An assembly as defined in claim 12 wherein said hinges of said shutter members of said first set each comprise:

a first spiral section attached to a slat of a shutter member of said first set;

a second spiral section attached to a slat of a shutter member of said second set; and a link comprising third and fourth spiral sections, said third spiral section adapted to interlock said first spiral section in a manner that allows rotation of said first slat relative to said link, and said fourth spiral section adapted to interlock said second spiral section in a manner that allows rotation of said second slat relative to said link.

15. An assembly as defined in claim 12 wherein said first extension members are connected to said links.

16. An assembly as defined in claim 12 wherein said first and second side walls of said shutter tracks are spaced apart by a distance and wherein each of said guide channels has a width substantially less than said distance.

17. An assembly as defined in claim 12 wherein said guide channels comprise a rigid member oriented parallel to said second side wall, said rigid member and said second side wall being spaced apart by a distance greater than a width of said first extension members.

18. An assembly as defined in claim 12 wherein said shutter members of said second set further comprise a second end portion with a second extension member which extends outwardly from said second end portion, said second extension members adapted to avoid said guide means and to be disposed outside of said guide channels when said shutter is in said extended position.

19. An assembly as defined in claim 12 wherein said guide means comprises an angled plate.

20. An assembly as defined in claim 12 wherein said guide means comprises an angled plate attached to said end wall proximate said first side wall and shutter support member and angled toward said second side wall and away from said shutter support member.

21. An assembly as defined in claim 12 wherein each of said extension members comprises a pin.

22. An assembly as defined in claim 12 wherein each of said extension members comprises a roller.

23. A rolling shutter assembly, comprising:

a shutter support member;

a shutter coupled to said shutter support member, said shutter comprising a plurality of slats and a plurality of hinges interconnecting said slats, each of said slats having a pair of end portions;

a pair of shutter tracks;

means for rolling said shutter from an extended position in which said end portions of said slats are disposed in said shutter tracks to a retracted position in which said shutter is rolled up on said shutter support member; and a rigid member adapted to removably engage a plurality of said hinges when said shutter is in said extended position thereby preventing motion of any of said engaged hinges relative to any other of said engaged hinges, said rigid member preventing rotation of said slats attached to said engaged hinges about said engaged hinges.

24. An assembly as defined in claim 23 further comprising extrusions integrally attached to said slat portions connected to said engaged hinges, said extrusions proximate to said engaged hinges, said rigid member adapted to fixably engage said extrusions.

25. An assembly as defined in claim 23 wherein said rigid member comprises an inner member having a plurality of first jaws and an outer member having a plurality of second jaws, said second jaws corresponding to said first jaws, said inner member slidably engaging said outer member, said first and second jaws adapted to fixably engage said engaged hinges when one of said first and second jaws are biased toward the other of said first and second jaws.

26. A rolling shutter assembly, comprising:

a shutter support member;

a shutter coupled to said shutter support member, said shutter comprising a plurality of slats and a plurality of hinges interconnecting said slats, each of said slats having a pair of end portions, one of said hinges comprising:

a first spiral section attached to a first of said slats;

a second spiral section attached to a second of said slats; and a link comprising third and fourth spiral sections, said third spiral section adapted to interlock said first spiral section in a manner that allows rotation of said first slat relative to said link, and said fourth spiral section adapted to interlock said second spiral section in a manner that allows rotation of said second slat relative to said link;

a pair of shutter tracks; and means for rolling said shutter from an extended position in which said end portions of said slats are disposed in said shutter tracks to a retracted position in which said shutter is rolled up on said shutter support member.

27. An assembly as defined in claim 26 wherein said some of said hinges are adapted to allow said first slat to rotate about said hinge between about 270° and 330° relative to said second slat.

28. A rolling shutter assembly, comprising:

a shutter support member;

a shutter coupled to said shutter support member, said shutter comprising a plurality of slats and a plurality of hinges interconnecting said slats, each of said slats having a pair of end portions, one of said hinges comprising:

a first hinge section attached to a first of said slats;

a second hinge section attached to a second of said slats, said second hinge section adapted to interlock said first hinge section in a manner that allows rotation of said first slat relative to said second slat; and a rigid member integrally attached to said first hinge section, said rigid member adapted to stop rotation of first hinge section relative to said second hinge section at a fixed point in said rotation;

a pair of shutter tracks; and means for rolling said shutter from an extended position in which said end portions of said slats are disposed in said shutter tracks to a retracted position in which said shutter is rolled up on said shutter support member.

29. An assembly as defined in claim 28 wherein said first and second hinge sections comprise spiral sections.

30. An assembly as defined in claim 28 wherein said rigid member further comprises a cantilever beam, said cantilever beam bearing upon said second hinge section when said first hinge section is at said fixed point in said rotation.

* * * * *